United States Patent [19]

McPhee

[11] Patent Number: 4,671,332

[45] Date of Patent: Jun. 9, 1987

[54] WALLET AND METHOD OF MAKING SAME

[76] Inventor: Charles J. McPhee, 8562 Larthorn Dr., Huntington Beach, Calif. 92646

[21] Appl. No.: 806,395

[22] Filed: Dec. 9, 1985

[51] Int. Cl.[4] ..... A45C 1/06; A45C 11/18; B31B 41/26; B31B 41/60

[52] U.S. Cl. ..... 150/132; 150/147; 206/39; 493/210; 493/244; 493/267; 493/931; 29/428

[58] Field of Search ..... 150/132, 141, 146, 147, 150/135, 139; 206/39, 39.7, 260; 493/243, 244, 267, 261; 112/402, 262.1; 493/193, 210, 411, 413, 931; 29/428; 229/72, 75

[56] References Cited

U.S. PATENT DOCUMENTS

| | | | |
|---|---|---|---|
| 175,822 | 4/1876 | Conlan | 150/141 X |
| D. 241,189 | 8/1976 | Clark | 150/147 X |
| 2,149,030 | 2/1939 | Moore | 493/261 X |
| 2,288,704 | 7/1942 | Herbener | 150/141 |
| 2,654,409 | 10/1953 | Cox | 150/132 X |
| 2,737,991 | 3/1956 | Bass | 150/132 |
| 3,162,227 | 12/1964 | Bakken | 150/132 X |
| 3,360,027 | 12/1967 | Price | 150/132 |

*Primary Examiner*—William Price
*Assistant Examiner*—Sue A. Weaver
*Attorney, Agent, or Firm*—Tilton, Fallon, Lungmus

[57] ABSTRACT

A wallet or billfold of exceptionally thin construction having a limited number of folds, pockets, and thickness of material, yet being capable of holding both bills and credit cards in separate pockets. Access to the card pocket may be achieved without unfolding the wallet or exposing the currency carried in it.

11 Claims, 11 Drawing Figures

WALLET AND METHOD OF MAKING SAME

BACKGROUND AND SUMMARY

The popularity of money clips has resulted at least in part from the fact that wallets tend to be undesirably bulky. Because of such bulk, they customarily produce unsightly and revealing bulges when carried, for example, in a trouser pocket, thereby detracting from the appearance and fit of the clothing and increasing the ease, if not the risk, of theft. The use of money clips only partially solves the problem, however, because a user may also wish to carry a limited number of cards such as, for instance, a drivers' license and selected credit cards. While it is not uncommon for those who use money clips to wrap bills around such cards before applying the clips, such practice has a number of shortcomings, including the fact that access to the drivers' license or any of the cards requires exposure of the currency wrapped about such cards.

While wallets of various constructions have been known in the art, as represented, for example, by U.S. Pat. Nos. 3,360,027, 2,737,991, 1,269,247, and Des. 241,189, applicant is unaware of any wallet constructions which overcome these problems. Accordingly, a main aspect of this invention lies in providing a wallet construction that is relatively thin and yet provides separate pockets for currency and cards, with the card pocket being arranged so that unfolding of the wallet, and exposure of the currency contained in it, are unnecessary for the purpose of removing and inserting such cards. In its most efficient form, the wallet may be formed from a single strip of flexible sheet material or, alternatively, from two pieces of such material. The finished wallet comprises a rectangular cover, ideally formed from a single thickness of flexible sheet material foldable along a transverse midline, and a card holder having a pair of generally rectangular superimposed panels joined together at their edges along two sides and one end to define an end-opening pocket. The card holder is disposed along the inner surface of the foldable cover with the opening of the pocket facing outwardly at one end of the cover. That panel of the card holder disposed immediately adjacent the inner surface of the cover is connected to the cover along one side edge and an end edge of such panel. When the wallet is in use, currency is folded about the card holder and is concealed from view by the cover and, since the pocket of the card holder faces endwise, cards may be removed from or inserted into the pocket without opening the cover.

The wallet may be fabricated from either one or two pieces of sheet material. In both cases a small rectangular patch of sheet material is secured to an elongated rectangular strip of such material so that the patch overlies one end portion of the strip and is secured to that strip along the side and end edges of the panel to define a pocket having an opening facing away from the end of the strip to which the patch is secured. Where a one-piece construction is employed, the patch is in fact an extension of the strip and is reversely folded over the end portion of the strip as a first step in the securing operation. Where a two-piece construction is employed, the patch is a separate element which is then sealed to the strip as described.

In both the one-piece and two-piece constructions, the remaining steps in fabricating the wallet are essentially the same. The elongated rectangular strip, with the patch secured to its end portion, is then reversely folded away from the patch along a transverse fold line adjacent to and parallel with the opening of the pocket. A pair of adjacent side edges of the strip are then secured together along one side edge of the patch to produce a second pocket or chamber for receiving and retaining currency.

Other advantages, features, and objects of the invention will become apparent from the specification and drawings.

DETAILED DESCRIPTION OF PREFERRED EMBODIMENTS

Figure 1:
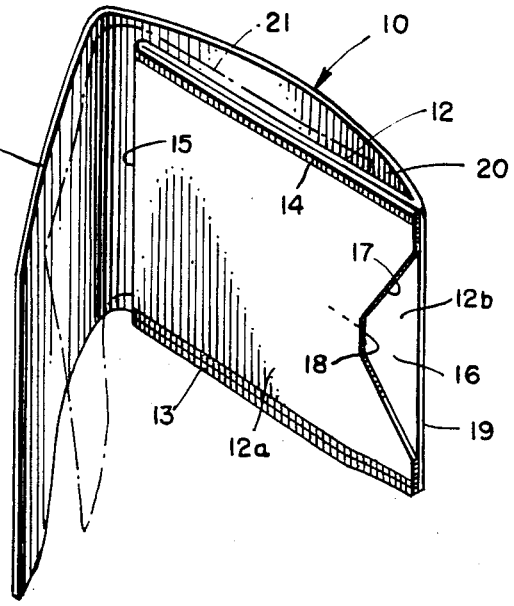
FIG. 1 is a perspective view of a wallet embodying the invention, the wallet being shown in partially opened condition.

Referring to the drawings, the numeral 10 generally designates a wallet or billfold that has a generally rectangular cover 11 foldable along its transverse midline as indicated in FIG. 1. The dimensions of the cover are standard (approximately 3 inches by 7.5 inches) but variations from those dimensions may be made as long as the wallet is of adequate size to serve its purposes and is not too large to fit easily into a pocket or purse. The material of the wallet may also be varied with flexible plastics, leather, and cloth being appropriate. A heat-sealable plastic material such as vinyl has been found particularly effective, but any tough, durable, and flexible sheet material may be used.

Within the folded cover 11 is a card holder 12 which is rectangular in shape, having a width approximately the same as that of the cover and a length slightly less than one half the cover's length. The card holder is also formed of flexible sheet material which may be, but is not necessarily, the same material as the cover. The card holder 12 comprises a pair of generally rectangular superimposed panels **12*a* and 12*b* that are joined together along opposing longitudinal side edges 13, 14 and also along inner end edges 15 adjacent the fold line of the cover. The card holder is therefore closed along three sides but is provided with an outwardly-facing opening 16. If desired, panel 12*a* may have its outer edge cut back as indicated at 17 in FIG. 1 to provide a notch or recess that facilitates access to licenses, credit cards, and other types of cards that may be carried within pocket 18 of the card holder 12**.

It is particularly significant that the card holder 12 is disposed along the inner surface of cover 11 with its opening 16 facing outwardly or endwise, away from the fold line of cover 11. That panel **12*b* of the card holder 12 immediately adjacent the inner surface of the cover is connected to the cover along side edge 13 and also along adjacent end edge 19. A second pocket 20 is therefore formed between the card holder and the cover, such pocket being open along both the longitudinal side edge 14 and innermost edge 15 of the card holder. Currency may be folded within the wallet as indicated by phantom line 21 in FIG. 1, with one half of each bill being received within the second pocket 20 and the other half being folded about the card holder and disposed between panel 12***a* and the free end portion 11*a* of the cover.

It is to be noted that the cover 11 should be a single panel of material. While this does not exclude the possibility that the cover might have a lining or facing different than the material of its outer surface, the term "single panel" is here used to mean that the cover ideally has no pockets or dividers of its own.

When the wallet is opened or partially opened (FIG. 1), one half of the group of bills 21 carried by the wallet becomes fully exposed. Since only one half of each bill is supported by the wallet when the cover is open, the denomination of the bills may be easily ascertained and any selected bill may be easily removed.

Figure 2:
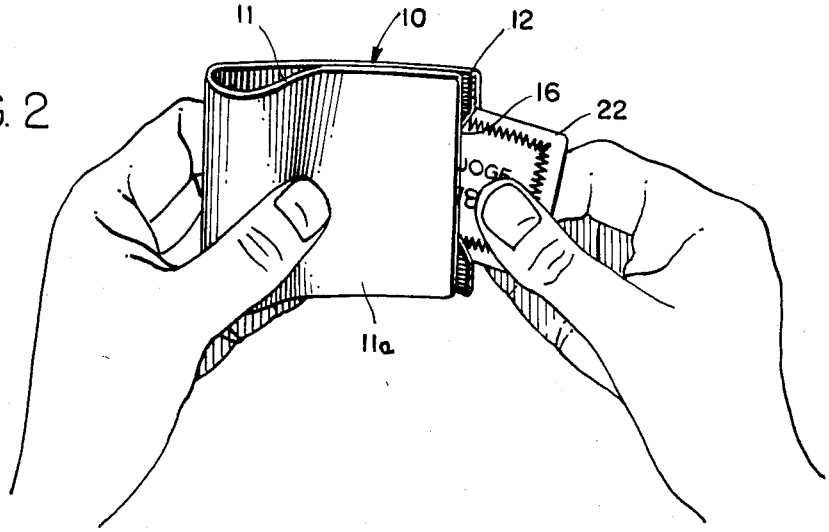
FIG. 2 is a perspective view showing the wallet in use, with a credit card being removed (or inserted) while the cover of the wallet is closed to conceal the currency contained therein.

An important aspect of the invention lies in the fact that despite the ease with which the bills may be inspected, removed, or inserted, it is also possible for a user to remove a card from the card holder, or to insert one into the holder, without exposing any of the bills. As shown in FIG. 2, the fact that the card pocket 12 has an end-facing opening 16 permits a user to remove or insert a card 22 without opening cover 11.

Figure 3:
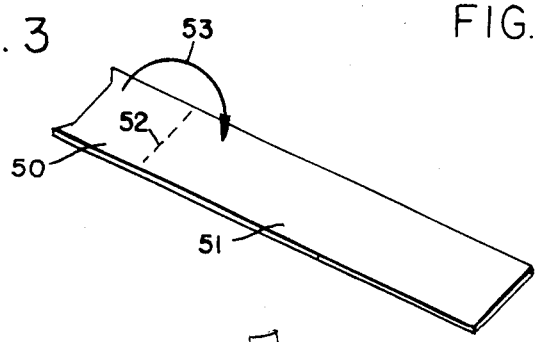
FIGS. 3, 3A, and 4–8 are somewhat schematic perspective views illustrating the method steps of making the wallet of this invention.
Figure 3A:
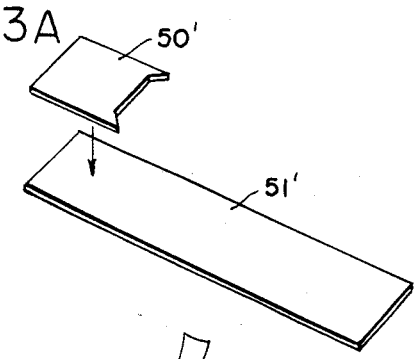
Figure 4:
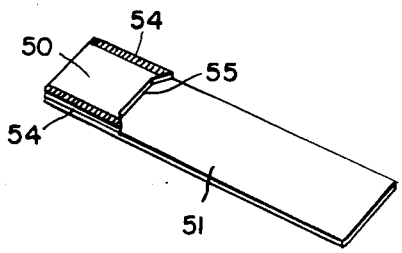

In describing the construction of the wallet, it has been pointed out that certain panels are "joined" or "connected" to each other, or to the cover, along certain edges. It is to be understood that such connection may result from the fact that the respective panels or other portions are integrally formed rather than being formed separately and then stitched, heat sealed, or otherwise attached. Ideally, the wallet is formed from a single piece of flexible sheet material as represented by the method steps depicted in FIGS. 3–8. Alternatively, for reasons brought out more fully hereinafter, the wallet may be formed from two pieces joined together as indicated in FIG. 3A. Thus, in FIG. 3A a small rectangular patch 50' is placed over one end of a strip 51' of flexible sheet material, the length of the patch being slightly less than one third of the length of the strip. In FIG. 3, on the other hand, the patch 50 is formed integrally with strip 51 and is folded into position over the strip along fold line 52 as indicated by arrow 53. In either case, the patch 50 50' is positioned over the strip 51 51' and is then sealed along its side edges 54 to the strip. If the patch is formed integrally with the strip, then no further sealing of the patch is required; however, if the patch is applied as a separate element (FIG. 3A), then an additional sealing operation must be undertaken in which the end edges of the strip 51' and patch 51' are sealed together. In either case, a pocket is formed with the opening 55 of the pocket facing away from the end of the strip to which the patch is secured (FIG. 4).

Figure 9:
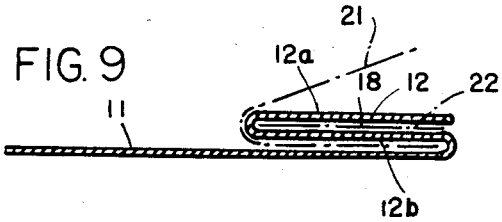
FIG. 9 is a schematic cross-sectional view along line 9—9 of FIG. 6.
Figure 10:
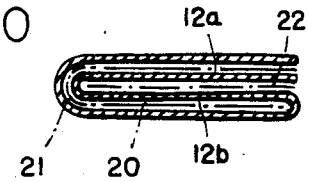
FIG. 10 is a schematic sectional view taken along line 10—10 of FIG. 8.
Figure 5:
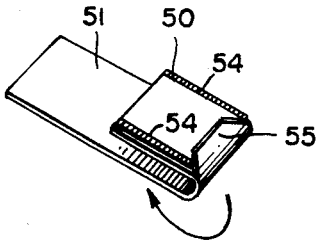
Figure 6:
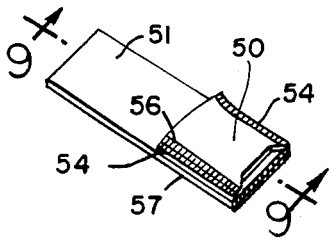
Figure 7:
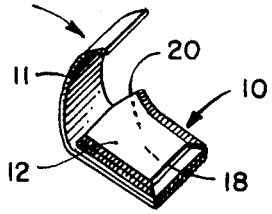
Figure 8:
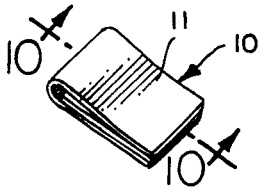

The steps depicted in FIGS. 4–8 are shown as they would apply to the one-piece construction of FIG. 3, but it is believed apparent that the same steps would be applicable to the two-piece construction of FIG. 3A. The strip 51 with the patch 50 sealed to it is reversely folded along a transverse fold line adjacent to and generally parallel with the opening 55 of the pocket (FIG. 5). A further sealing operation is undertaken in which a pair of adjacent side edges 56, 57 of the strip are sealed together along the length of the patch 50 (FIG. 6). This final sealing operation completes the construction of the wallet with FIGS. 7 and 8 depicting the finished wallet 10 with its end-facing card pocket 18 and its second pocket 20 for supporting currency between card holder 12 and cover 11. FIGS. 9 and 10 schematically illustrate the relationship when the wallet is open (FIG. 9) and closed (FIG. 10). Currency, represented by line 21, is partially supported within pocket 20, whereas a drivers' license or other cards, such as credit cards, represented by line 22, are supported within pocket 18.

Whether the wallet is formed from a single piece of material (FIG. 3) or from two such pieces (FIG. 3A) depends in part on whether the surfaces on both sides of the sheet material are the same and, if not, whether the exposed surface of the card holder, when the wallet is opened, should be the same as the outer surface of the cover. In FIG. 3, the surface of strip 51 facing the viewer becomes the outer surface of the finished wallet. Ordinarily, that surface has a texture or design that is distinctive and attractive. It will be noted, however, that when a one-piece construction is used and patch 50 is folded along line 52 over strip 51, the textured or decorated surface of the patch becomes concealed and the patch's opposite surface is exposed. If such an orientation is considered undesirable, it may be remedied by forming patch 50' as a separate piece and securing it to strip 51' so that the selected surfaces of the strip and patch face in the same direction.

While in the foregoing I have disclosed embodiments of the invention, and methods for producing them, in considerable detail for purposes of illustration, it will be understood by those skilled in the art that many of these details may be varied without departing from the spirit and scope of the invention.

I claim:

1. A wallet comprising a rectangular cover of flexible sheet material foldable along a transverse midline and having inner and outer surfaces; a card holder comprising a pair of generally rectangular superimposed panels joined together along two side edges and one end edge of each to define an end-opening pocket; said card holder being disposed along the inner surface of said cover with the opening of said pocket facing endwise from said cover; said card holder having one panel thereof immediately adjacent the inner surface of said cover connected to the cover along one of its side edges and along its end edge extending along said pocket opening.

2. The wallet of claim 1 in which said cover is formed of a single panel of flexible sheet material.

3. The wallet of claim 1 in which both of said panels of said card holder are formed integrally with said cover.

4. The wallet of claim 1 in which said one of said panels of said card holder is formed integrally with said cover and the other of said pair of panels is formed as a separate piece secured to said cover.

5. The wallet of claim 1 in which the panel of said card holder exposed when said cover is unfolded is cut back to define a recess at the opening of said pocket for facilitating the insertion and removal of cards from said card holder.

6. The wallet of claim 1 in which said cover and card holder are formed of flexible thermoplastic material.

7. A method of making a wallet, comprising the steps of securing a rectangular patch of flexible sheet material to an elongated rectangular strip of flexible sheet material so that the patch overlies one end portion of the strip and is secured to said strip along two side edges and one end edge of the patch to define a pocket having an opening facing away from the end of the strip to which said patch is secured; then reversely folding said strip away from said patch along a transverse fold line adjacent to and parallel with the opening of said pocket; and thereafter securing a pair of overlying side edges of said strip together along the length of one of said side edges of said patch.

8. The method of claim 7 in which said patch is formed integrally with said strip and said securing step involves first folding said patch over said end portion of said strip and then sealing two edges of said patch to said strip.

9. The method of claim 8 in which the two edges of said patch sealed to said strip during said sealing step are opposite side edges of said patch.

10. The method of claim 7 in which said patch is formed separately from said strip and is secured thereto by sealing two opposite side edges and one end edge of said patch to said strip.

11. The method of claim 7 in which said patch and strip are formed of flexible thermoplastic sheet material.

* * * * *